United States Patent [19]

Rose

[11] Patent Number: 5,054,638

[45] Date of Patent: Oct. 8, 1991

[54] BEVERAGE CAN HANDLE WITH KEY RING ATTACHED

[76] Inventor: Steven B. Rose, 4080 Huerfano Ave., #246, San Diego, Calif. 92117-5226

[21] Appl. No.: 484,495

[22] Filed: Mar. 23, 1990

[51] Int. Cl.[5] ..... B65D 25/26

[52] U.S. Cl. ..... 220/85 H; 220/94 R

[58] Field of Search ..... 220/85 H, 94 R; 206/101, 37.8

[56] References Cited

U.S. PATENT DOCUMENTS

| | | | |
|---|---|---|---|
| 1,509,829 | 9/1924 | Doty | 206/37.8 X |
| 2,784,578 | 3/1957 | Southwick | 220/85 H |
| 3,111,152 | 11/1963 | Goessling | 206/37.8 X |
| 4,602,723 | 7/1986 | DeMars | 220/94 R X |
| 4,898,297 | 2/1990 | Wheeler | 220/85 H |

*Primary Examiner*—Steven M. Pollard

[57] ABSTRACT

A handle device for releasable attachment to a beverage can. The handle device comprises an expansible, approximately D-shaped holder of resilient material having a curved hand-graspable portion, a portion to grip the top bead of a beverage can, a portion to grip the bottom bead of the beverage can, and a vertical portion connecting the bead gripping portions and spanning the curved hand-graspable portion. The handle device having a jump-ring connected to a key-ring.

4 Claims, 1 Drawing Sheet

BEVERAGE CAN HANDLE WITH KEY RING ATTACHED

SUMMARY OF THE INVENTION

It is an object of this invention to provide a novel handle device, having a key-ring attached thereto, which may be readily attached and removed from a beverage can.

It is a further object to provide a novel handle device for a beverage can which allows the handling of the beverage can without the direct contact of a human hand with the beverage can surface.

It is a further object to provide a novel handle device having a key-ring attached thereto.

The novel one-piece handle device for beverage cans comprises an expansible, approximately D-shaped holder of resilient material having a curved hand-graspable portion, a portion to grip the top bead of a beverage can, a portion to grip the bottom bead of the beverage can, and a verticle portion connecting the bead gripping portions and spanning the curved hand-graspable portion. The handle device having a jump-ring connected to a key-ring.

DESCRIPTION OF THE PREFERRED EMBODIMENT

Figure 1:
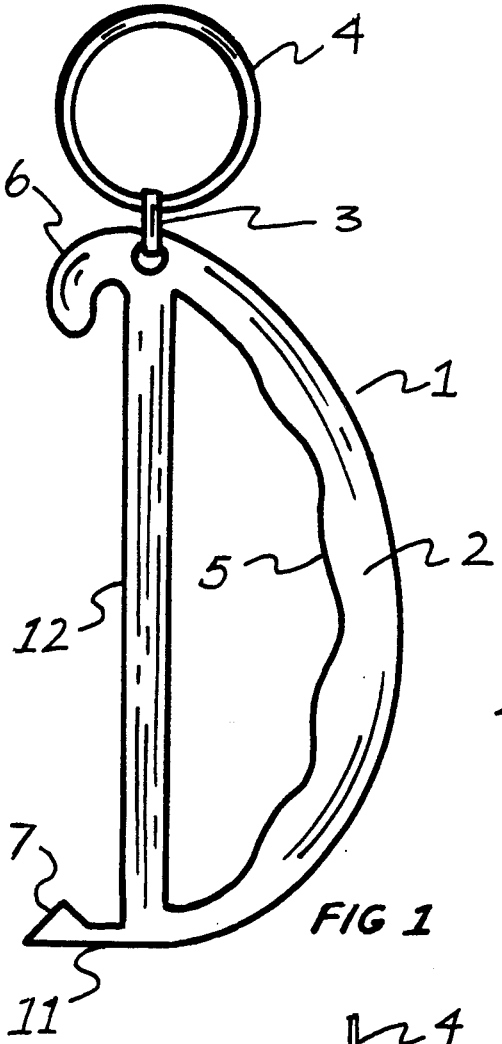
FIG. 1 is a side elevational view of the handle device and key-ring.
Figure 2:
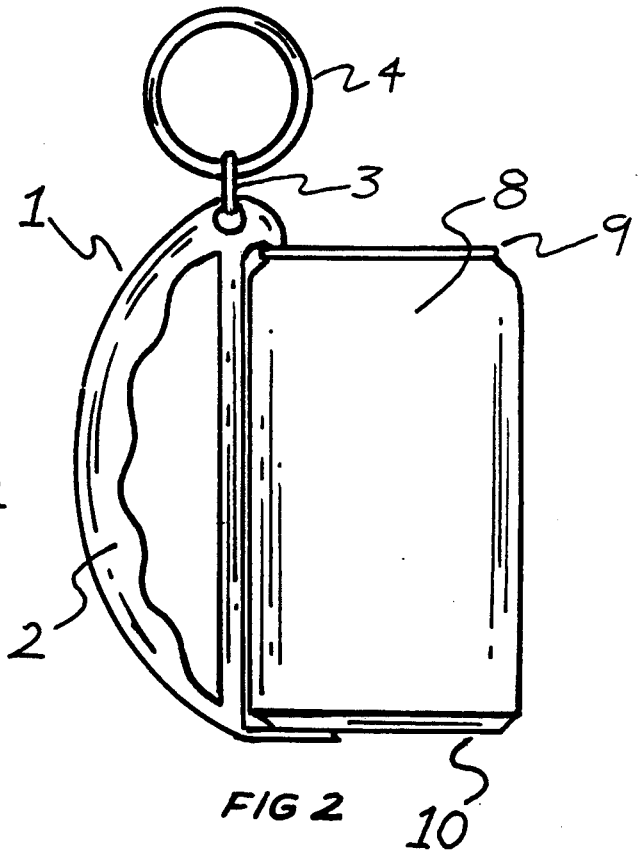
FIG. 2 is a side elevational view of the handle device and key-ring mounted upon a beverage can.
Figure 3:
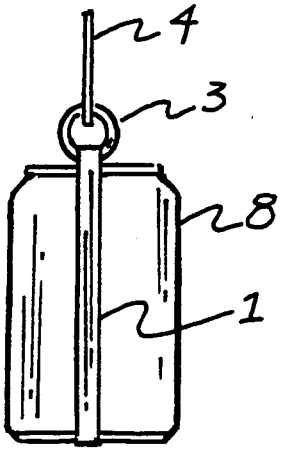
FIG. 3 is a rear elevational view of the handle device and key-ring showing the beverage can in dashed lines.

Referring now to the drawings and, more specifically, to FIGS. 1 and 2, it will be seen that the handle device 1 for beverage cans 8 is of one-piece construction and comprises an expansible, approximately D-shaped holder of resilient material having a curved hand-graspable portion 2. The curved hand-grapable portion 2 has finger grip depressions 5 located on the inside face of the curved hand-graspable portion 2. The handle device 1 has, at the upper end, a portion to grip the top bead 9 of a beverage can 8 comprising a hook-like protusion 6 and at the lower end, a portion to grip the bottom bead 10 of the beverage can 8 comprising a hook-like projection 7 having a flat bottom surface 11. A verticle portion spans the curved hand-graspable portion 2 and connects the bead gripping portions 6, 7. The handle device 1 also includes a jump-ring 3 and key-ring 4 mounted to the upper end of the handle device 1 adjacent the upper end of the verticle portion 12.

The handle device 1 is of one-piece construction and may be injection molded or stamped from plastic or other lightweight material, including non-temperature conducting material. The hook-like protusion 6 of the portion to grip the top bead 10 of the beverage can 8 is rounded to facilitate snapping over the top bead 9 of the beverage can 8. The hook-like projection 7 to grip the bottom bead 10 of the beverage can 8 is V-shaped in side view, and is flat on the bottom surface 11 thereof to allow the beverage can 8 with handle device mounted theron to assume a stable position when placed upon a horizontal surface, note FIGS. 1 and 2, such as a table top, with the can bottom and the handle device bottom surface 11 in contact therewith.

The handle device 1, FIGS. 1 and 2, is designed such that it may easily be attached to and removed from a beverage can, such as the pull-tab-type, etc., by simple pressure exerted on the handle device in a direction perpendicular to the verticle axis of the beverage can 8.

Figure 4:
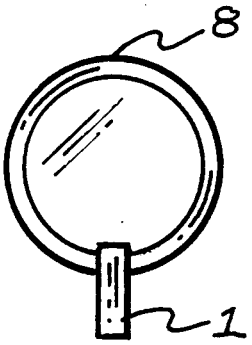
FIG. 4 shows the jump-ring and key-ring.

A jump-ring is fitted to the handle device 1, at the upper end therof as shown in FIGS. 1 and 2, which in turn is connected to a plastic or metal key-ring, as shown in FIG. 4.

An advantage of the handle device 1 is the ability to handle a beverage can 8 without direct contact with a human hand with the exterior surface of the beverage can 8, thus protecting the hand from cold or hot beverage can 8 surfaces. The key-ring 4 feature is dual purpose, also allowing for the handle device to be carried, transported, and/or concealed in clothing, handbags, etc..

What is claimed is:

1. A handle device for releasable attachment to a beverage can, said handle device comprising: a one-piece, expansible, approximately D-shaped holder of resilient material having a curved hand-graspable portion, a portion to grip a top bead of a beverage can, a portion to grip the bottom bead of the beverage can, a verticle portion connecting the bead gripping portions and spanning the curved hand-graspable portion, and a key-ring attached to said D-shaped holder.

2. The handle device as set forth in claim 1, wherein said curved hand-graspable portion has finger grip depressions located on an inside surface of said hand-graspable portion in facing relationship to said verticle portiion.

3. The handle device as set forth in claim 1, wherein the portion to grip a bottom bead of the beverage can has a flat bottom surface.

4. The handle device as set forth in claim 1, wherein said key-ring is attached to said D-shaped holder by a jump-ring which is mounted to said D-shaped holder through an opening therein located adjacent the upper end of said verticle portion.

* * * * *